US007030373B2

(12) United States Patent
Vestal et al.

(10) Patent No.: US 7,030,373 B2
(45) Date of Patent: Apr. 18, 2006

(54) MALDI PLATE CONSTRUCTION WITH GRID

(75) Inventors: Marvin L. Vestal, Framingham, MA (US); Timothy E. Hutchins, Natick, MA (US)

(73) Assignees: Applera Corporation, Framingham, MA (US); MDS Inc., Concord (CA)

( * ) Notice: Subject to any disclaimer, the term of this patent is extended or adjusted under 35 U.S.C. 154(b) by 77 days.

(21) Appl. No.: 10/742,423

(22) Filed: Dec. 19, 2003

(65) Prior Publication Data

US 2005/0133714 A1 Jun. 23, 2005

(51) Int. Cl.
*H01J 49/04* (2006.01)

(52) U.S. Cl. ..... 250/288; 250/284

(58) Field of Classification Search ..... 250/286, 250/287, 288, 440.11; 428/335; 435/23, 435/24, 6, 287.2; 436/177; 536/24.3
See application file for complete search history.

(56) References Cited

U.S. PATENT DOCUMENTS 6,265,715 B1 * 7/2001 Perreault et al. ..... 250/288
6,617,575 B1 * 9/2003 Cramer ..... 250/288

* cited by examiner

*Primary Examiner*—Nikita Wells
*Assistant Examiner*—David A. Vanore
(74) *Attorney, Agent, or Firm*—Andrew T. Karnakis

(57) ABSTRACT

A MALDI plate construction is provided to support a sample in a manner to effect mass spectrometry of the sample. The plate construction comprises a sample receiving surface, a plate holder for retaining the sample receiving surface and an electrically conductive grid positioned adjacent to the sample receiving surface and in electrical contact with the plate holder.

17 Claims, 3 Drawing Sheets

MALDI PLATE CONSTRUCTION WITH GRID

The present teachings relate to a plate construction useful in matrix-assisted laser desorption ionization (MALDI) analysis.

The choice of a matrix substance for MALDI is dependent upon the type of sample molecules to be analyzed; dozens of different matrix substances are known. The task of the matrix substance is to separate the sample molecules from each other and incorporate them into the matrix, to transform the sample into the gas phase during laser bombardment by the formation of a vapor cloud without destroying the biomolecules and, if possible, without attachment of the matrix molecules, and finally to ionize the sample by protonation or deprotonation or similar processes. In some instances, it has been found advantageous to incorporate the sample or analyte molecules in some form into the usually crystalline matrix substances during their crystallization or at least into the boundary-surfaces between the small crystals.

Various methods are known for applying the sample and matrix to a sample plate. The simplest of these is the pipetting of a solution with sample and matrix onto a sample support plate that can be a metal plate. With metal plates, the solution drop is wetting on the metal surface area, the size of which corresponds approximately to the diameter of the drop and is dependent on the hydrophilicity of the metal surface and the characteristics of the droplet. After the solution dries, the sample spot consists of small matrix crystals spread over the formerly wet area. Typically there is not a uniform coating of the wetted area, but rather the matrix crystal distribution is dispersed.

At the present time, stainless steel plates are widely used substrates for MALDI plates, which plates can be uncoated or coated with thin surface modifying agents such as a fluorinated polymer. However, some sample generating techniques lend themselves to effect sample deposition or confinement on substrates other than a metal, such as a porous membrane or animal tissue. While these non-metal substrates can be useful for retaining samples to be analyzed, the laser desorption and ionization processes can impart a charge onto the sample surface that can interfere with the electrostatic fields in the mass spectrometer, resulting in inaccurate or non-useful sample analysis. This problem is especially noted when the substrate or sample is non-conducting to the electrical charge.

SUMMARY

The present teachings provide a plate construction useful for MALDI mass spectrometry that comprises a sample receiving surface on which at least one sample is deposited, a holder for retaining the sample receiving surface and an electrically conductive grid positioned above the sample receiving surface and in electrical contact with the holder. In some embodiments, the grid can be formed of intersecting electrically conductive wires that form open areas within the intersecting points of the wires. In various embodiments, the grid can be positioned in contact with the sample or the sample receiving surface and can be positioned to permit a light beam from a laser to pass through the open areas of the grid and then onto the sample or the sample receiving surface to desorb and ionize the sample.

These and other features of the present teachings will become more apparent from the description herein.

BRIEF DESCRIPTION OF THE DRAWINGS

The skilled artisan will understand that the drawings described below are for illustration purposes only. The drawings are not intended to limit the scope of the present teachings in any way.

DESCRIPTION OF VARIOUS EMBODIMENTS

Figure 1:
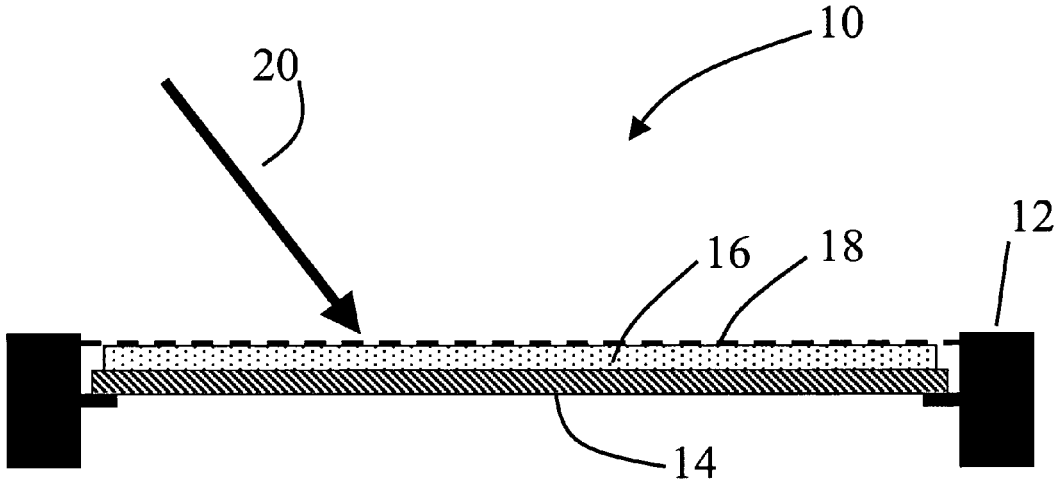
FIG. 1 is a schematic side view of a MALDI plate in use with a laser beam by which some embodiments of this invention can be practiced.

In the following description, the substances that are to be analyzed, including the biosubstances, are referred to as "analytes" or "samples". The terms "biomolecules" or "biosubstances" used herein include oligonucleotides (i.e., the essential building blocks of the living world), proteins, peptides and lipids, including their particular analogs and conjugates, such as glycoproteins or lipoproteins. Other substances that can be amenable to MALDI analysis are small molecules, metabolites, natural products and pharmaceuticals.

For the analysis of large biomolecules, mass spectrometry with ionization by matrix-assisted laser desorption and ionization (MALDI) has become a standard method. For the most part, time-of-flight mass spectrometers (TOF-MS) are used for this purpose, but ion cyclotron resonance spectrometers (FT-ICR or Fourier transform ion cyclotron resonance) as well as high-frequency quadrupole, ion trap mass spectrometers and hybrid instruments composed of combinations of the above such as quadrupole time-of-flight (Q-TOF) instruments, can be applied as well.

In accordance with various embodiments of this invention, a plate construction useful for MALDI mass spectrometry is provided which comprises an electrically conductive grid formed of spaced apart intersecting electrically conducting wires. The grid can be formed from two or more sets of wires that are joined together at points where the wires intersect to form openings subtended by intersecting wires. Any number of sets of wires can be utilized to form the grid having a wide variety of opening shapes. Alternatively, the grids can be of a single piece construction such as a flat foil where holes of desired dimensions can be formed by manufacturing processes such as photo chemical etching or laser machining. In various embodiments, the grid can be deposited directly onto the sample or sample receiving surface by sputtering or vapor deposition processes to form a conducting pathway across the sample or the sample receiving surface. In various embodiments, the sets of electrically conducting wires can be formed of the same or different metal, metal alloy or other electrically conducting material such as graphite, stainless steel or nickel.

The wires forming the grid can have a diameter between about 0.0002 inches and 0.025 inches, or the diameter can be between about 0.0005 inches and 0.005 inches. Typically, the openings or through spaces (holes) of the grid can have a width between about 0.005 inches and 0.100 inches, or the openings can be between about 0.015 inches and 0.035 inches. The grid thus formed can have an open area of at least 80%, or at least 85%, or at least 90% of the area of the grid. In various embodiments, representative suitable electrically conductive materials from which the wires can be formed are stainless steel, nickel, gold or the like.

The sample receiving surface can be any solid surface, whether conductive or non-conductive, that will accept a deposited sample in a desired configuration such as discrete samples from a multiplicity of sources or a continuous sample such as an effluent from a liquid chromatography column. In various embodiments, representative suitable sample receiving surfaces can be glass, metal, plastic, porous membranes formed of polymeric materials, tissue slices or the like. When utilizing a membrane, the sample can be deposited directly on the membrane or can be deposited indirectly from another sample support substrate such as a gel that can be a polyacrylamide gel or a tissue slice. The sample receiving surface can also be any material that already contains the analyte or sample of interest, such as tissue slices or electrophoresis gels.

In various embodiments, the sample receiving surface can be supported by a support substrate surrounded by a sample plate holder that positions and provides support to the sample receiving surface. The position of the sample or samples on the sample receiving surface can be fixed and can be in contact with the overlaying conductive grid. The overlaying grid is in electrical contact with the sample plate holder.

A MALDI plate construction in accordance with various embodiments of the present invention permits use of a wide variety of sample receiving surfaces that minimize or prevent charging of the sample receiving surface. Such a plate construction improves sample analysis accuracy as compared to a sample analysis technique wherein significant sample or substrate charging is experienced. While an exact theoretical explanation is not known, it is thought that the inclusion of a conductive grid improves the performance of the mass spectrometer by providing a uniform electric field across the sample plate surface. This process is believed to be aided by the grid functioning to dissipate all or a portion of the electrical charge produced by the laser beam so that any electrical charge buildup on the sample or sample receiving substrate is correspondingly reduced. These conditions, in turn, provide better analytical results as compared to a sample plate construction design that does not include the conductive grid.

Referring to FIG. 1, a MALDI plate construction 10 comprises a plate holder 12 to which can be attached a support substrate 14 such as a solid plate. The plate holder 12 can extend about the periphery of the support substrate 14. A sample receiving surface 16 that can be a porous membrane or sliced tissue (human or animal) or a stainless steel plate or the like can be positioned on the support substrate 14. An electrically conductive grid 18 can be secured to the plate holder 12 in a manner that permits contact of the grid 18 with the sample receiving surface 16. The grid 18 is in electrical contact with the plate holder 12. The electrically conductive grid 18 can be removed from the support substrate 14 or from the plate holder 12. This permits storage, reuse, cleaning or repair of the support substrate 14, plate holder 12 and grid 18. The grid 18 can be conveniently attached to the plate holder 12 by removable mechanical devices such as screws or can be affixed by direct means such as spot welding. If the grid 18 is permanently mounted to the plate holder 12, the support substrate 14 and sample receiving surface 16 should be removable to allow for storage, reuse, repair or cleaning of the various component parts. A laser beam suitable for MALDI analysis can contact the sample receiving surface 16 in the general direction of arrow 20. The laser beam can pass through the opening areas in grid 18 to contact the sample receiving surface 16 thereby to desorb and ionize sample on the sample receiving surface 16.

Figure 2:
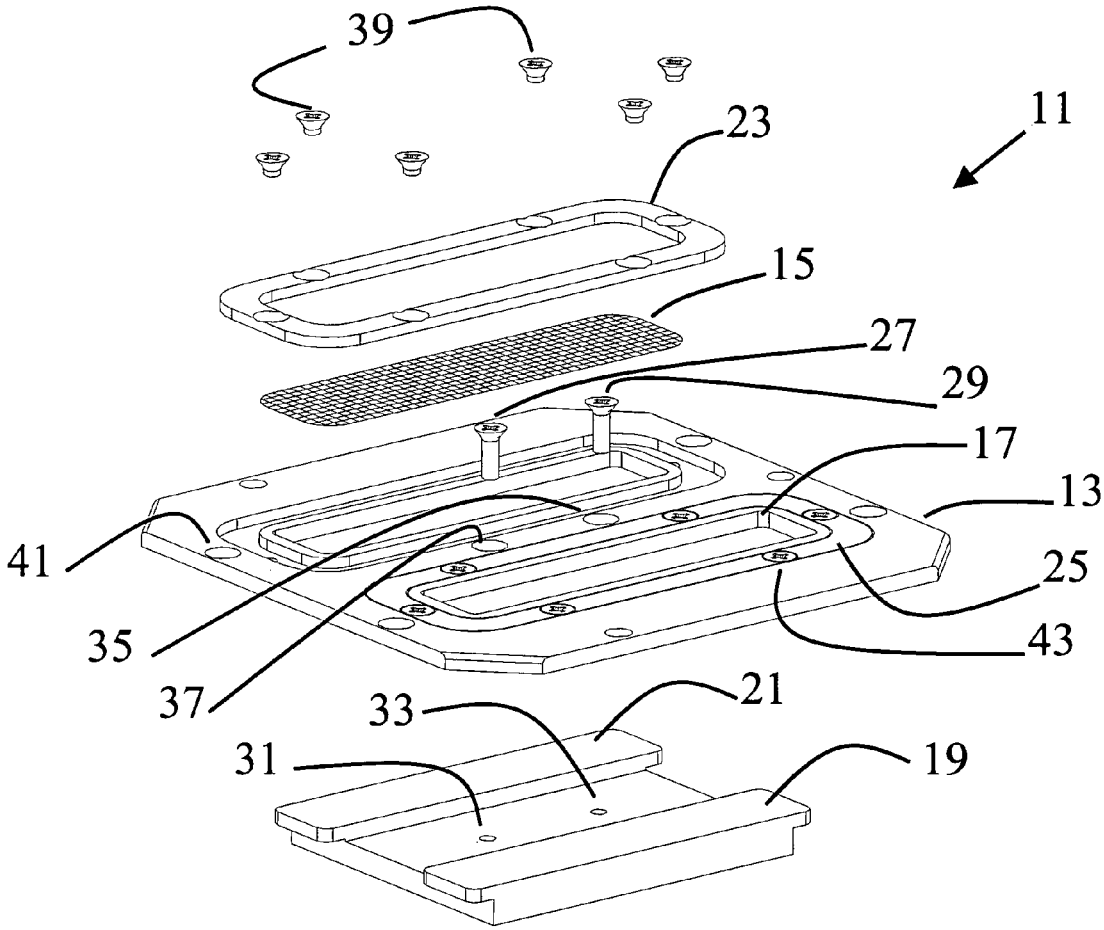
FIG. 2 is an exploded view of a MALDI plate construction with one of the two conductive grids removed to allow more detail of the construction to be shown by which some embodiments of this invention can be practiced.

Referring to FIG. 2, a MALDI plate construction 11 comprises a plate holder 13, a pair of conductive grids 15 (for sake of clarity, one of the grids 15, normally located in the region depicted by reference numeral 17, has been removed to show details of the overall assembly), a pair of support substrates 19 and 21 and two grid-retaining plates 23 and 25. Sample receiving surfaces such as a porous membrane or sliced tissue can be positioned on support substrates 19 and 21. Support substrates 19 and 21 can be positioned within and mated with adjacent open wells formed within the plate holder 13. The support substrates 19 and 21 can be retained on plate holder 13 by screws 27 and 29 that engage threads 31 and 33 through holes 35 and 37. Other suitable fastening techniques can be used, for example, when the plate holder 13 is formed of stainless steel, a magnet with sufficient force to hold the assembly together can be used. Plate 23 can be retained in plate holder 13 by screws 39 that engage threads 41. Plate 25 can be similarly retained on plate holder 13 by screws 43. When the plate construction 11 is assembled, the grids 15 can be located laterally adjacent one another in the same plane, with both being in electrical contact with the plate holder 13. After a MALDI mass spectrometry analysis is completed, screws 27 and 29 can be detached from threads 31 and 33 so that sample surfaces on support substrates 19 and 21 can be replaced with new sample surfaces. This permits the various components of the plate construction 11 to be stored, reused, repaired or cleaned.

EXAMPLES

Aspects of the present teachings may be further understood in light of the following example, which should not be construed as limiting the scope of the present teachings in any way.

Figure 3:
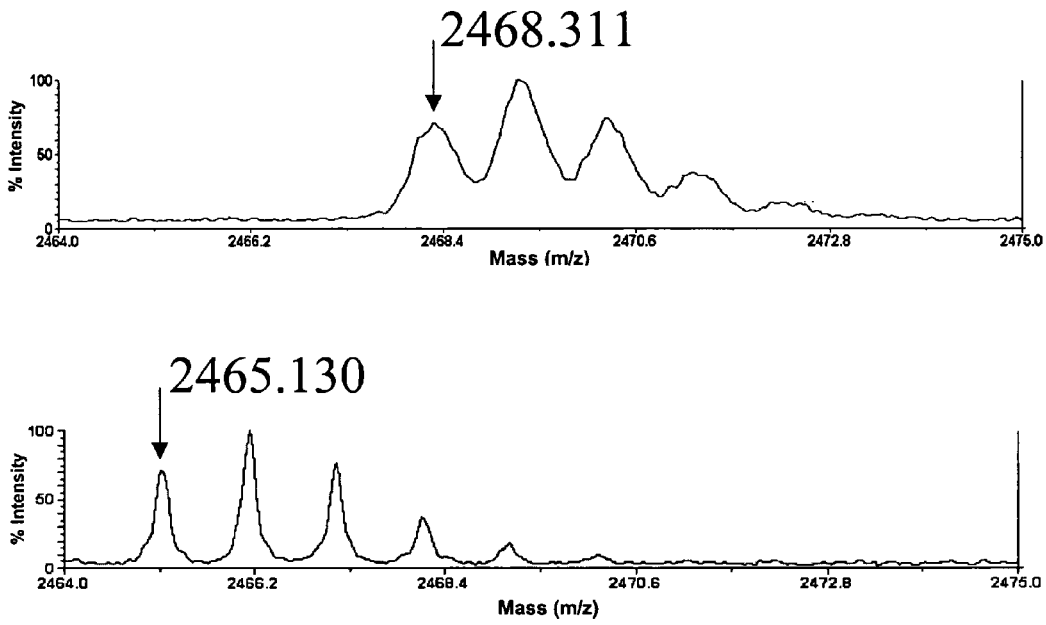
FIG. 3 depicts comparison MALDI mass spectra of a mixture of peptide analytes on a non-conducting membrane surface with the top panel representing sample analysis without the use of a conductive grid and with the bottom panel representing sample analysis with the use of a conductive grid.

Two sample peptides (ACTH clip 18-39) were analyzed using a 4700 Proteomics Analyzer time of flight mass spectrometer (Applied Biosystems, Foster City, Calif.). The calculated mass for the ACTH clip 18-39 peptide based on its known structure is 2465.198 Daltons. Data was acquired and MALDI mass spectra of the peptide sample were generated around the molecular ion region. FIG. 3 shows a comparison of the effect of the grid on the mass spectrometry analysis. Without the grid (top panel), the mass spectral resolution is poor and the masses are shifted to a higher than expected mass value, in this example more than 3 Daltons higher than the calculated mass. When the grid is used with the MALDI analysis (bottom panel), the spectrum has significantly improved mass resolution and the mass accuracy is within fractions of a Dalton of the calculated mass.

We claim:

1. A plate construction for supporting at least one sample to effect mass spectrometry of the sample that comprises:

a sample receiving surface upon which the at least one sample is deposited, a plate holder adapted to retain the sample receiving surface and at least one electrically conductive grid positioned above the sample receiving surface and in electrical contact with the plate holder and wherein at least a portion of the grid is in physical contact with the sample receiving surface.

2. The plate construction of claim 1 further comprising a second electrically conductive grid positioned laterally adjacent the at least one electrically conductive grid.

3. The plate construction of claim 1 wherein the sample receiving surface is detachable from the plate holder.

4. The plate construction of claim 1 wherein the grid is detachable from the plate holder.

5. The plate construction of claim 1 further comprising a support substrate adapted to provide support for the sample receiving surface.

6. The plate construction of claim 1 wherein the grid is formed of intersecting electrically conductive wires.

7. The plate construction of claim 6 wherein the grid is formed from at least two sets of intersecting electrically conductive wires.

8. The plate construction of claim 1 wherein the grid is formed of a unitary construction with a plurality of through holes of predetermined dimension formed therein.

9. The plate construction of any one of claims 1, 2, 3, 4 or 5 wherein the sample receiving surface comprises a porous membrane.

10. The plate construction of any one of claims 1, 2, 3, 4 or 5 wherein the sample receiving surface comprises animal tissue.

11. The plate construction of any one of claims 6 or 7 wherein the wires have a diameter of between about 0.0002 inches and 0.025 inches.

12. The plate construction of any one of claims 6 or 7 wherein the wires have a diameter of between about 0.0005 inches and 0.005 inches.

13. The plate construction of any one of claims 6, 7 or 8 wherein the openings of the grid have a width between about 0.005 inches and 0.100 inches.

14. The plate construction of any one or claims 6, 7 or 8 wherein the openings of the grid have a width between about 0.015 inches and 0.035 inches.

15. The plate construction of any one of claims 6, 7 or 8 wherein the openings of the grid form an open area of at least 80% of the area of the grid.

16. The plate construction of any one of claims 6, 7 or 8 wherein the openings of the grid form an open area of at least 85% of the area of the grid.

17. The plate construction of any one of claims 6, 7 or 8 wherein the openings of the grid form an open area of at least 90% of the area of the grid.

* * * * *